United States Patent [19]

Dick et al.

[11] Patent Number: 4,610,047

[45] Date of Patent: Sep. 9, 1986

[54] VACUUM CLEANER OF INTERCHANGEABLE ATTACHMENT TYPE

[75] Inventors: Larry C. Dick, North Olmsted; Ernest R. Scott, Mayfield Heights, both of Ohio

[73] Assignee: The Scott & Fetzer Company, Cleveland, Ohio

[21] Appl. No.: 722,316

[22] Filed: Apr. 11, 1985

[51] Int. Cl.[4] ..... A47L 5/30

[52] U.S. Cl. ..... 15/319; 15/328; 15/332; 15/339; 15/390

[58] Field of Search ..... 15/319, 339, 328, 392, 15/390, 332

[56] References Cited

U.S. PATENT DOCUMENTS

| | | | |
|---|---|---|---|
| 1,667,729 | 5/1928 | Fleming | 15/328 |
| 1,891,175 | 12/1932 | Petersen | 15/328 |
| 2,175,004 | 10/1939 | Snyder | 15/332 |
| 2,218,035 | 10/1940 | Benson | 15/332 |
| 2,538,464 | 1/1951 | MacFarland | 15/390 |
| 2,563,541 | 8/1951 | MacFarland et al. | 15/328 X |
| 3,608,333 | 9/1971 | Selley et al. | 15/389 X |
| 3,790,987 | 2/1974 | MacFarland | 15/392 |
| 4,472,856 | 9/1984 | Goodin | 15/337 |

*Primary Examiner*—Chris K. Moore

*Attorney, Agent, or Firm*—Pearne, Gordon, Sessions, McCoy, Granger & Tilberry

[57] ABSTRACT

An upright vacuum cleaner has a removable powered brush vacuum nozzle which can be removed and replaced without operation of a belt lifter. The power linkage from the cleaner's fan motor to the nozzle brush includes a positive-drive clutch, and control means active at the inception of each operation of the cleaner in the brush-and-vacuum mode to engage the clutch prior to starting the fan motor and active at the conclusion of operation of the cleaner in the brush-and-vacuum mode to disengage the clutch only after stopping the fan motor.

12 Claims, 17 Drawing Figures

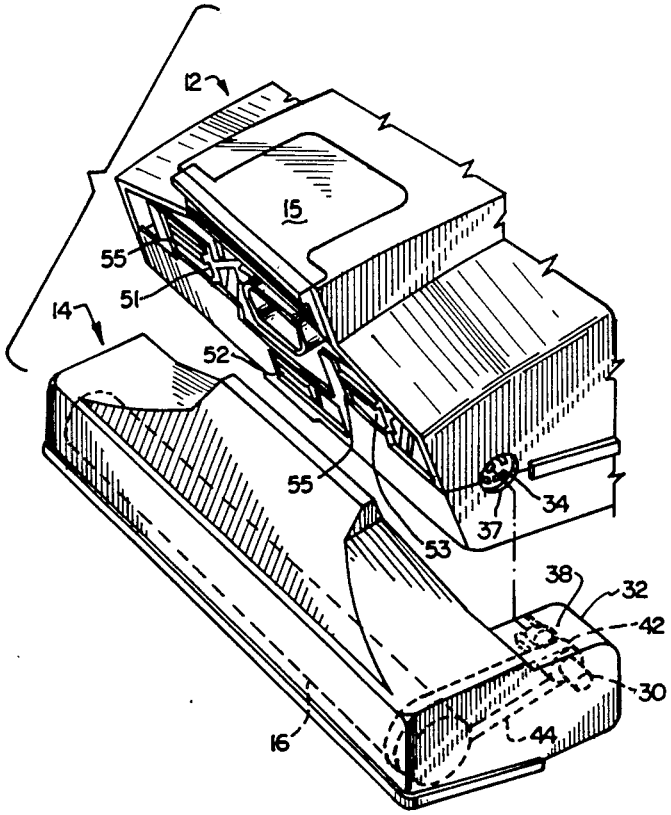
FIG. 1A
FIG. 1
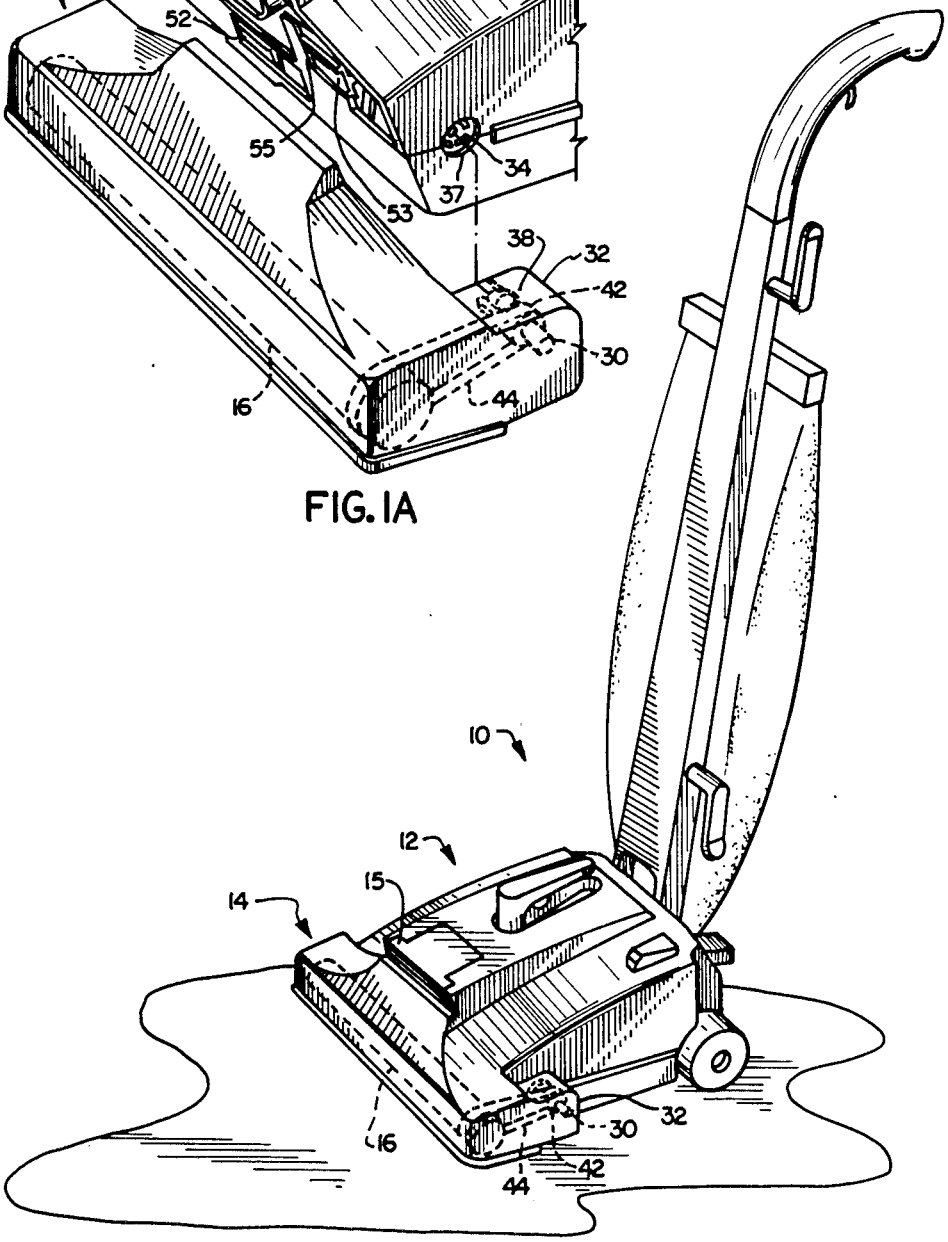

14
12
11
65
53
12
67
21
10
10
68
69
50
66
6
11
18
7
49
26
7
25
27
16
51
8
24
8
28
34
5
5
4
40
42
4
32
30
6

FIG. 10
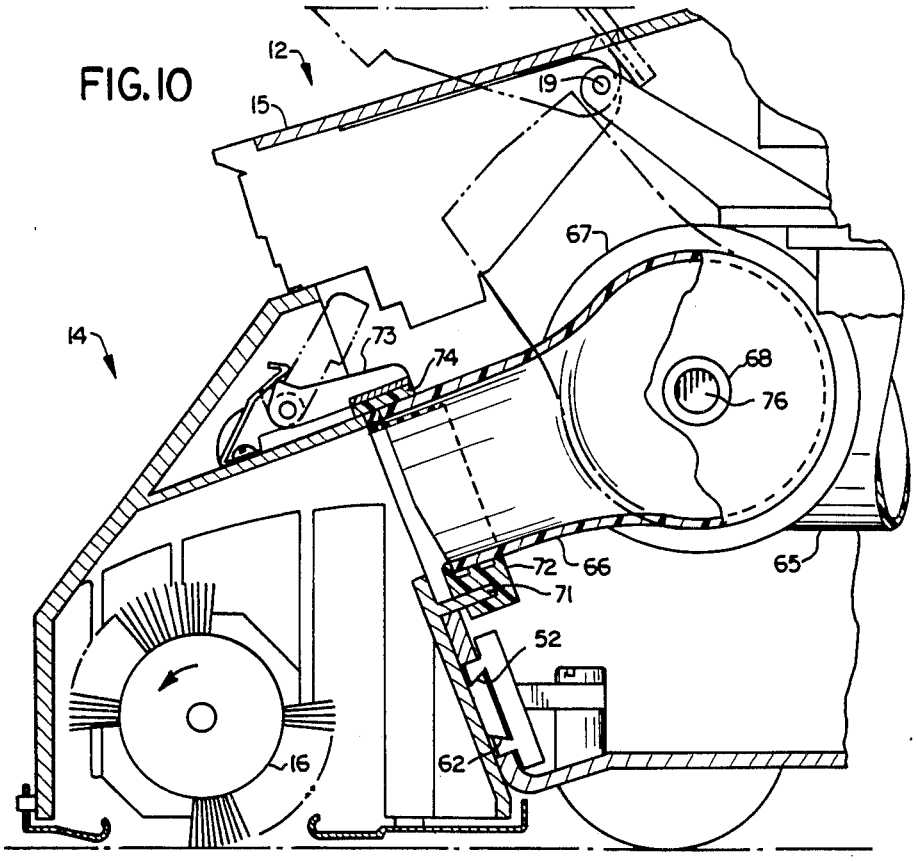
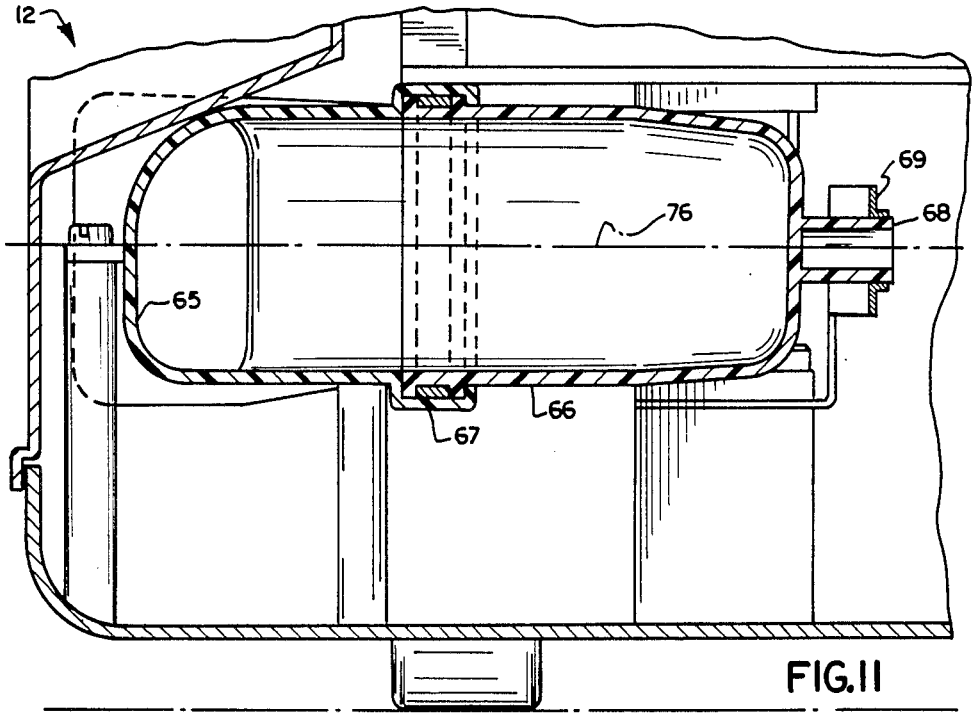
FIG. 11

VACUUM CLEANER OF INTERCHANGEABLE ATTACHMENT TYPE

This invention relates to vacuum cleaners of the interchangeable attachment type having a powered brush within a vacuum nozzle, such powered brush nozzle being attached to but removable from the wheeled fan motor carriage of the vacuum cleaner, and the brush being driven by the fan motor while the cleaner is in its brush-and-vacuum mode.

BACKGROUND

Vacuum cleaners of the interchangeable attachment type to which the invention relates are provided with a powered brush vacuum nozzle that is removable from the wheeled motor fan carriage so that the vacuum nozzle may be replaced with other on-the-floor attachments such as floor polishing heads, rug shampooer heads or the like, all of which have powered brushes or other elements which are interchangeably driven by the fan motor. By this means a single power source, the fan motor, is utilized both for powered brush vacuum cleaning and for the different operations performed by the attachments that are substituted for the vacuum nozzle.

In vacuum cleaners of this general type, it is necessary to limit the torque delivered to the driven brush within the vacuum nozzle, or to the driven elements within other substituted attachments. This is necessary both for the safety of the user and to prevent damage to the motor if an obstacle becomes lodged in the nozzle or other accessory so as to block rotation of the brush or other driven element. Torque is limited by providing a slip clutch in the drive linkage between the motor and the driven brush or other element. The slip clutch may be simply a belt-and-pulley connection utilizing a smooth belt which will slip in its pulley when a given degree of torque is exceeded.

It is obviously desirable to make it as convenient as possible for the user to change back and forth between the powered brush nozzle and one of the other attachments or to change between the other attachments, without being required to manipulate a belt lifter in order to establish and release the drive connection.

It is also desirable that the user be able to use the vacuum fan to provide vacuum for vacuum wands or other vacuum tools that do not have linkage-driven brushes or other linkage-drive elements (although some may have turbo-driven elements), and to do so without requiring removal of the mounted powered brush nozzle (or other attachment) and without having to manipulate a belt lifter in order to disconnect the powered brush or other powered element.

EXAMPLES OF PRIOR ART

U.S. Pat. No. 2,538,464 to MacFarland shows an interchangeable attachment type vacuum cleaner of a general kind that is in wide use today. Belt lifter manipulation is required to exchange the powered brush vacuum nozzle with other on-the-floor attachments. Belt lifter manipulation is also required to disconnect the power brush when using the cleaner with, for example, a vacuum hose and wand.

U.S. Pat. No. 3,608,333 to Selley et al. shows an interchangeable attachment type vacuum cleaner requiring no manipulation of a belt lifter, but wherein there is no means for disengaging the motor drive while the powered brush nozzle is attached, and there is no slip clutch between the motor and powered brush.

U.S. Pat. No. 3,790,987 to MacFarland shows on interchangeable attachment type vacuum cleaner requiring no manipulation of a belt lifter and wherein there is a slip clutch between the motor and powered brush, but wherein there is no means for disengaging the motor drive while the powered brush nozzle is attached.

U.S. Pat. No. 4,472,856 to Goodin shows an upright vacuum cleaner, not of the interchangeable head type, in which a pivoting duct is provided for attachment of vacuum hose and wand. No means is provided to disconnect the powered brush in the (undetachable) vacuum nozzle during use of the vacuum hose and wand.

THE PRESENT INVENTION

The present invention no only provides for highly convenient changeover between a powered brush vacuum nozzle and other powered attachments, but also provides means whereby no changing or removal of the mounted powered brush nozzle (or other attachment) and no manipulation of a belt lifter are required to disconnect the powered brush and allow the vacuum fan to be used to provide vacuum for wands or other vacuum tools that do not have brushes or other mechanically driven elements. This makes it possible, for example, to shift between using the powered brush nozzle and the vacuum wand without having to mount or dismount the powered brush nozzle, without having to manipulate a belt lifter, and without driving of the powered brush when it is not in use. According to the present invention, in addition to the above-mentioned provision for a slip clutch for limiting torque delivered to the powered attachments, such as the powered brush nozzle, additional means is provided for automatically completely declutching the brush or other driven element of the powered brush nozzle or other attachment, even when the attachment is mounted on the fan motor carriage, except when the vacuum nozzles or other attachments are in actual use.

While the advent of microprocessor controls has seemingly made it possible to automatically control solenoid-powered automatic clutches in small appliances in response to the user's selection of operating mode, to our knowledge no satisfactory clutching arrangement has heretofore been provided for actually accomplishing selection-responsive automatic clutching and unclutching of the mechanical drives of powered brush vacuum heads and similar powered attachments. Such attachments and the wheeled fan motor carriage must be compact in construction, and particularly must be of limited vertical height, so that the bulk and particularly the vertical dimension available in which a clutch may be mounted is limited. This size limitation puts a severe demand on clutch performance because, since the available clutch face area is small, the torque transmitted per unit area must be very high. It is believed that up to the present time, this constraint has not been overcome by any practical solenoid-operated clutching system for vacuum cleaners of the interchangeable attachment type.

According to the present invention, the automatic clutching is done by a positive drive clutch controlled by a microprocessor in such a way that engagement and disengagement always occur when the fan motor is off, and the high torque-transmitting capacity of the positive drive is realized when the fan motor is on while the clutch is engaged. Space constraints are thereby met while still providing sufficient torque capacity.

DESCRIPTION OF THE DRAWINGS

FIG. 1 is an isometric illustration of a cleaner embodying the invention.

FIG. 1A is an enlarged, exploded, fragmentary view showing the front of the fan motor carriage and the detachable powered brush vacuum nozzle.

FIGS. 4–13 are views, of varying scales, taken from correspondingly numbered planes shown in other FIGS., as follows: 4(3), 5(3), 6(3), 7(3), 8(3 and 6A), 9(4), 10(3), 11(3), 12(3), 13(12).

DETAILED DESCRIPTION OF THE INVENTION

In the following description of an example of the invention, the figures in which elements are labeled are indicated in parentheses.

The vacuum cleaner, generally indicated at 10(1), includes a wheeled motor-fan carriage 12(1–7,9–13) and a removable powered brush vacuum nozzle 14(1–5,7,10,12, 13). The vacuum nozzle includes a powered brush 16(1–5, 10,12) driven by the fan motor 18(3,4,6) when the vacuum cleaner control is in the brush-and-vacuum mode following pushing of the start or "on" switch 20(2). The onset of this brush-and-vacuum mode will be more fully described below.

The drive linkage between the fan motor 18 and the powered brush 16 includes a toothed belt 22 (3–6,8) (teeth on belt omitted for simplification) between the output shaft of motor 18 and the input member 24 of a clutch 26(3–8), to be more fully described below.

Figure 6:
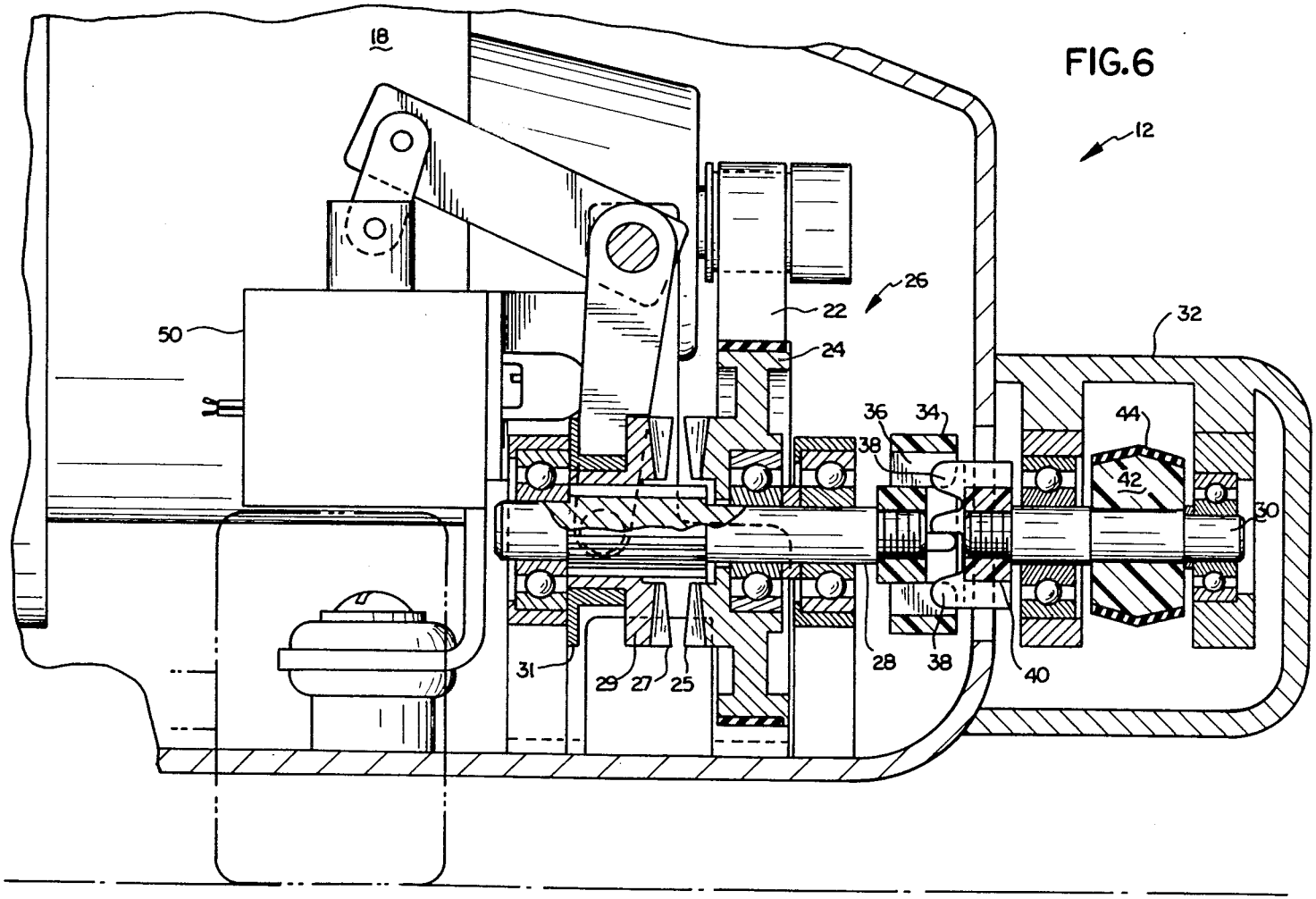

The output shaft 28(3,5,6) releasably connects to a stub shaft 30(1,3,4) carried by bearings in a side extension 32 (1,3,4,6,9) of removable vacuum nozzle 14, as most clearly seen in FIGS. 1A and 6. The releasable connection is via a female member 34(1A,3,5,6) carried on the output shaft 28 and having socket flanges 36(5,6) engaged by the resilient fingers 38(1A,6) of a male member 40(3,6) carried on the stub shaft 30.

A small crowned pulley 42(1,3,4,6) on the stub shaft 30 drives the brush roll via a smooth belt 44. The connection between the elements 42 and 44 comprises a slip clutch which establishes a maximum torque that can be transmitted to the powered brush 16.

Figure 9:
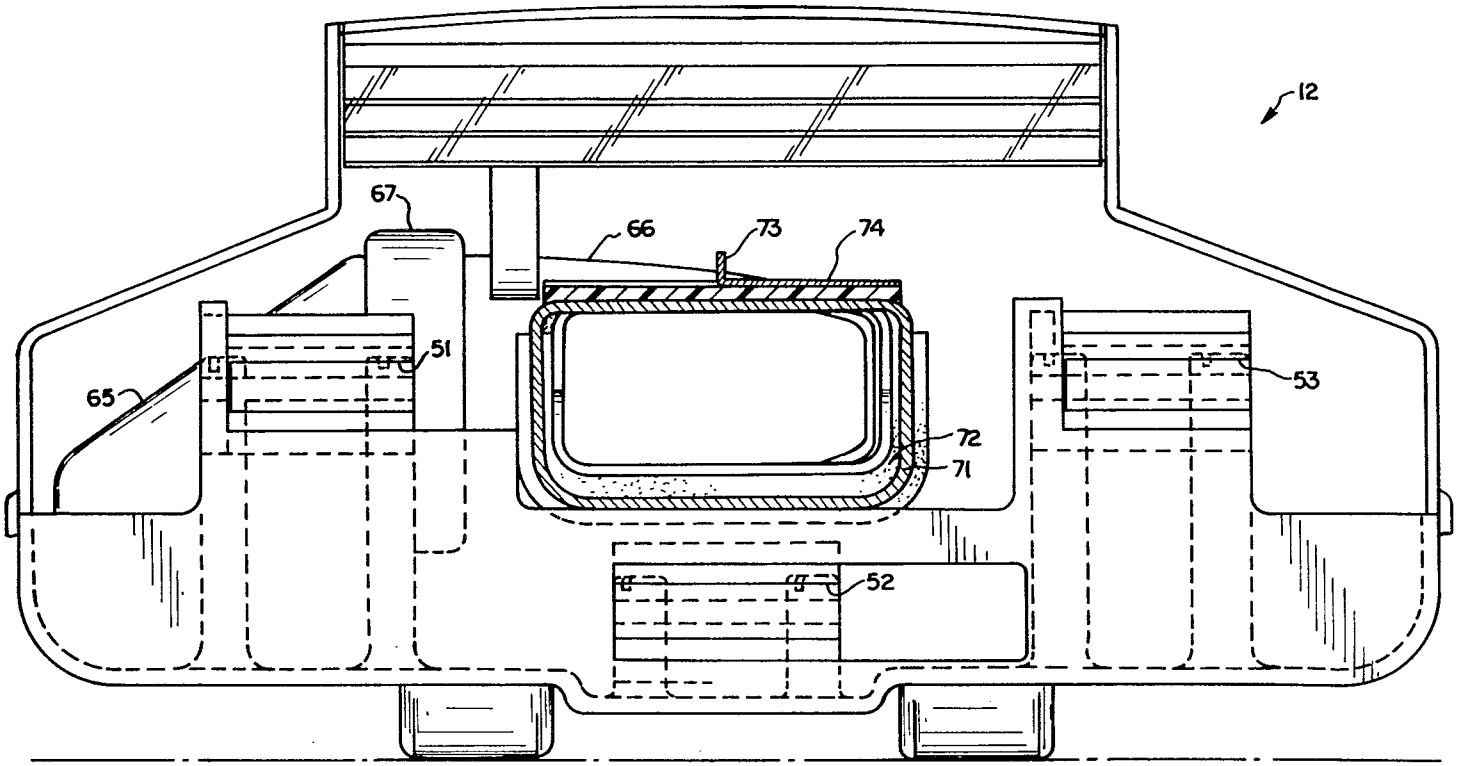
Figure 13:
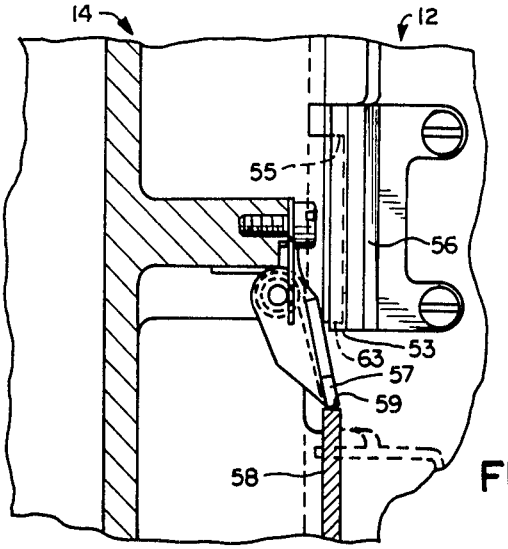
Figure 12:
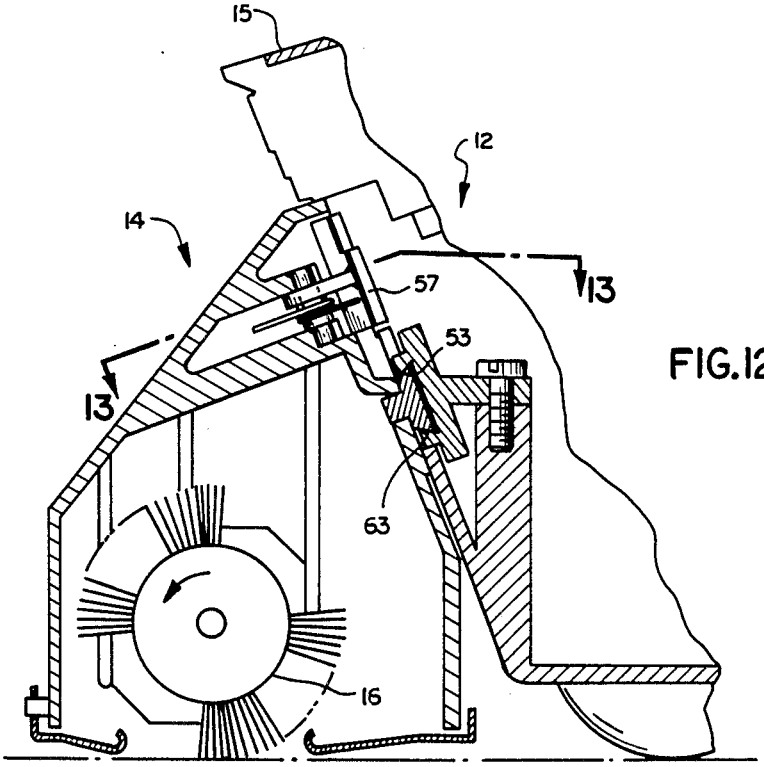

The vacuum nozzle 14 is mounted on the motor-fan carriage 12 by three short dovetail mountings comprising female members 51,52 and 53 bolted to carriage 12 (and whose distribution on the front face of carriage 12 is best seen in FIGS. 1A and 9) and three corresponding male members 61,62 and 63 fixed to the apposite face of nozzle 14. Endwise movement in the inserting direction is limited by end walls on flanges 55(1A,13) and in the removing direction is prevented by a finger-releasable spring-loaded latch 57(12,13) mounted on nozzle 13 and adapted to slide along wall 58(13) associated with motor carriage 12 during nozzle insertion and then snap into recess 59 as the nozzle reaches full insertion and the male dovetail members 61–63 engage the end walls or flanges 55. The engaging movement of latch 57 is limited by a stop extension 56.

Vacuum ducting leads from the detachable nozzle 14 to the fan or blower 21(2,3) carried by the motor-fan carriage 12. This ducting includes a fixed duct member 65(3–5,9–11) and a pivotable duct member 66. The latter is supported for rotation around imaginary axis 76(10,11). The circular flanged intake end of pivotable duct member 66 is rotatably received in circular end coller 67 formed on fixed duct member 65, to form a rotary joint. Pivotable duct member 66 is formed with a pivot stud 68 which is located at the intersection of axis 76 with the wall of member 66 and is rotatably received in a bracket 69 fixed to carriage 12. The circular end collar 67 and the pivot stud 68 are coaxial, and pivotable duct member 66 pivots on this axis.

The intake end of pivotable duct member 66 is received in the outlet of the nozzle 14 in a saddle flange 71(9,10) provided with a lip 72 of resilient material. The duct intake end is held down by a finger-releasable, over-center-type, spring-loaded hold-down clamp 73 provided with a resilient lip 74. The carriage 12 has a headlamp portion 15(1,5,10,12) which can be manually raised or lowered around its pivot point 19(5,10).

Figure 5:
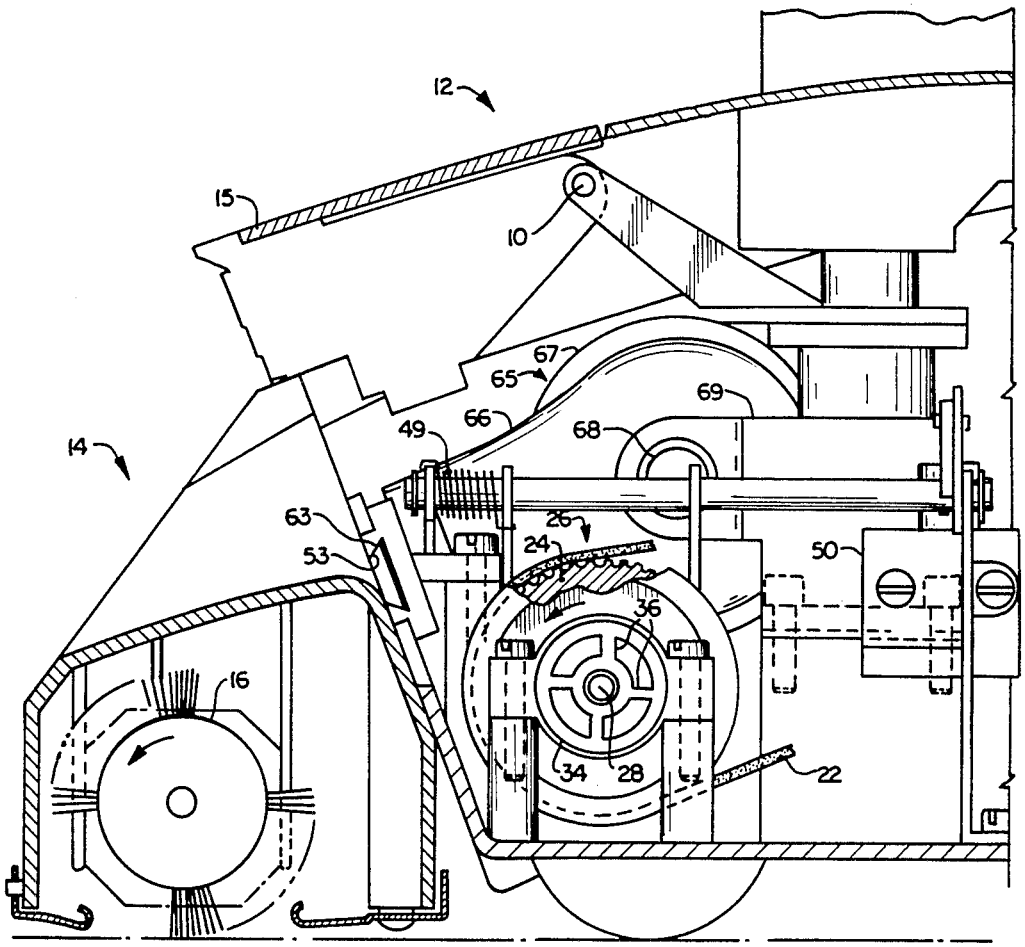

The nozzle 14 is removed by releasing the clamp 73, raising the headlamp portion 15 and pivotable duct 66 to the phantom positions seen in FIG. 10, releasing the latch 57, and sliding the nozzle in the releasing direction until the resilient fingers 38 have slipped out of the female member 34 and opening 37(1A,6) of the carriage 12 so that nozzle 14 is entirely free of carriage 12. Insertion or mounting is accomplished in the opposite sequence, latch 57 automatically snapping into place when the nozzle is fully inserted. The offset position of the flanges 36, best seen in FIG. 5, and the slightly angled configuration of the resilient fingers 38, best seen in FIG. 6, assure that proper driving engagement will be established between these elements no matter what the initial register is between them at the time the powered brush vacuum nozzle 14 is inserted or mounted on the carriage 12.

It is to be noted that when the female mounting members 51–53 and male members 61–63 are initially mutually engaged in their dovetailing engagement, the male and female members 40 and 34 of the releasable drive connection are thereby contained in alignment for proper engagement if the mounting members are progressively more fully engaged, so that both mounting and coupling are accomplished simply by positioning the nozzle for initial mutual engagement of the mounting means and then translating the nozzle laterally across the front of the motor-fan carriage to the fully engaged and latched position.

Other on-the-floor attachments are provided with mounting, latching, and power take-off means similar to those of a powered brush vacuum nozzle 14, and are mounted on and dismounted from the carriage 12 in like manner. When the powered brush vacuum nozzle has been in use and the user wishes to use vacuum wands or other vacuum tools that do not have brushes or other mechanically movable elements, removal of the nozzle 14 is not necessary. Instead, the user simply releases the clamp 73 and raises elements 15 and 66 to the phantom positions shown in FIG. 10. The outlet end of a vacuum hose or the like can then be coupled directly to the intake end of duct 66.

Figure 6A:
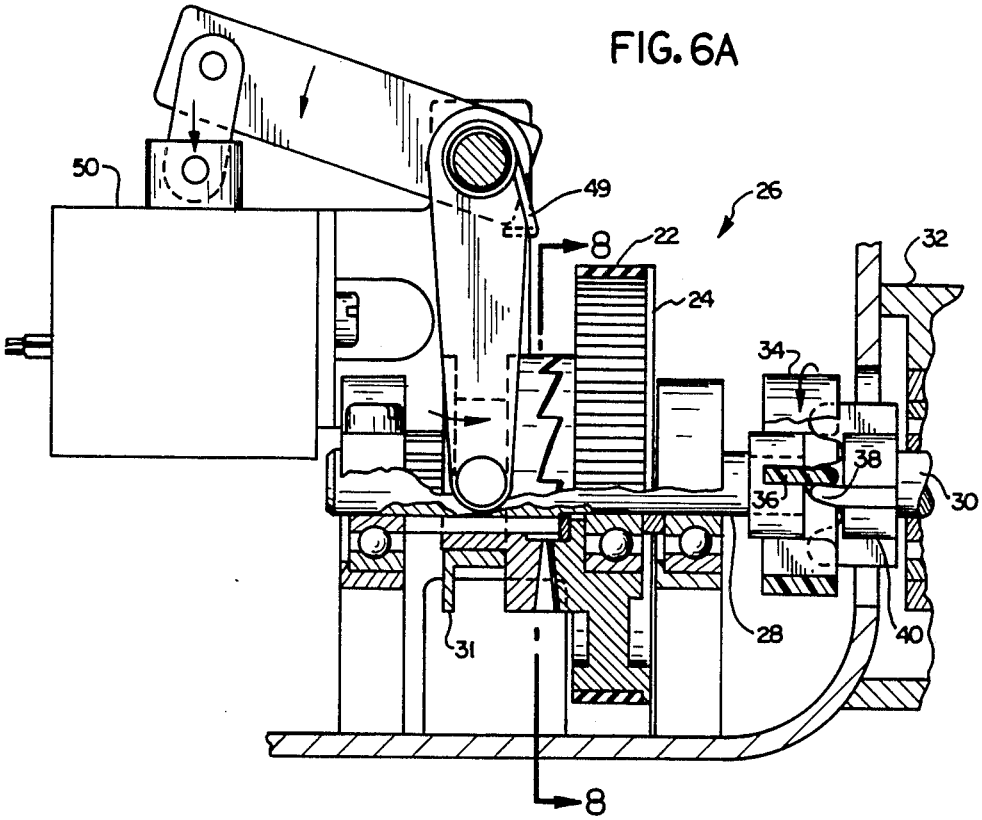
FIG. 6A is a view similar to FIG. 6, but showing the parts in a different position.
Figure 8:
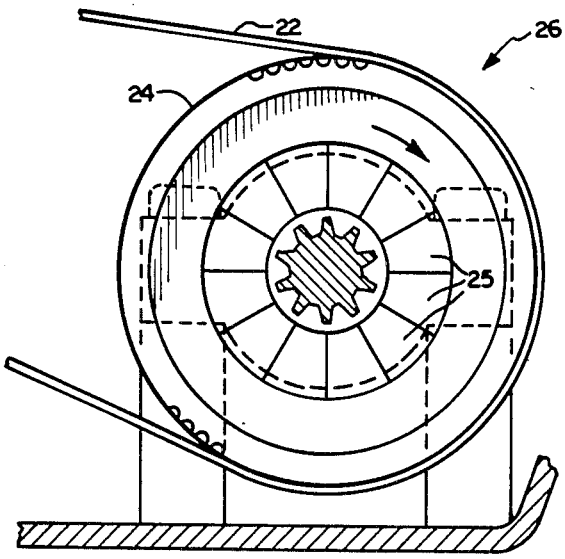
Figure 7:
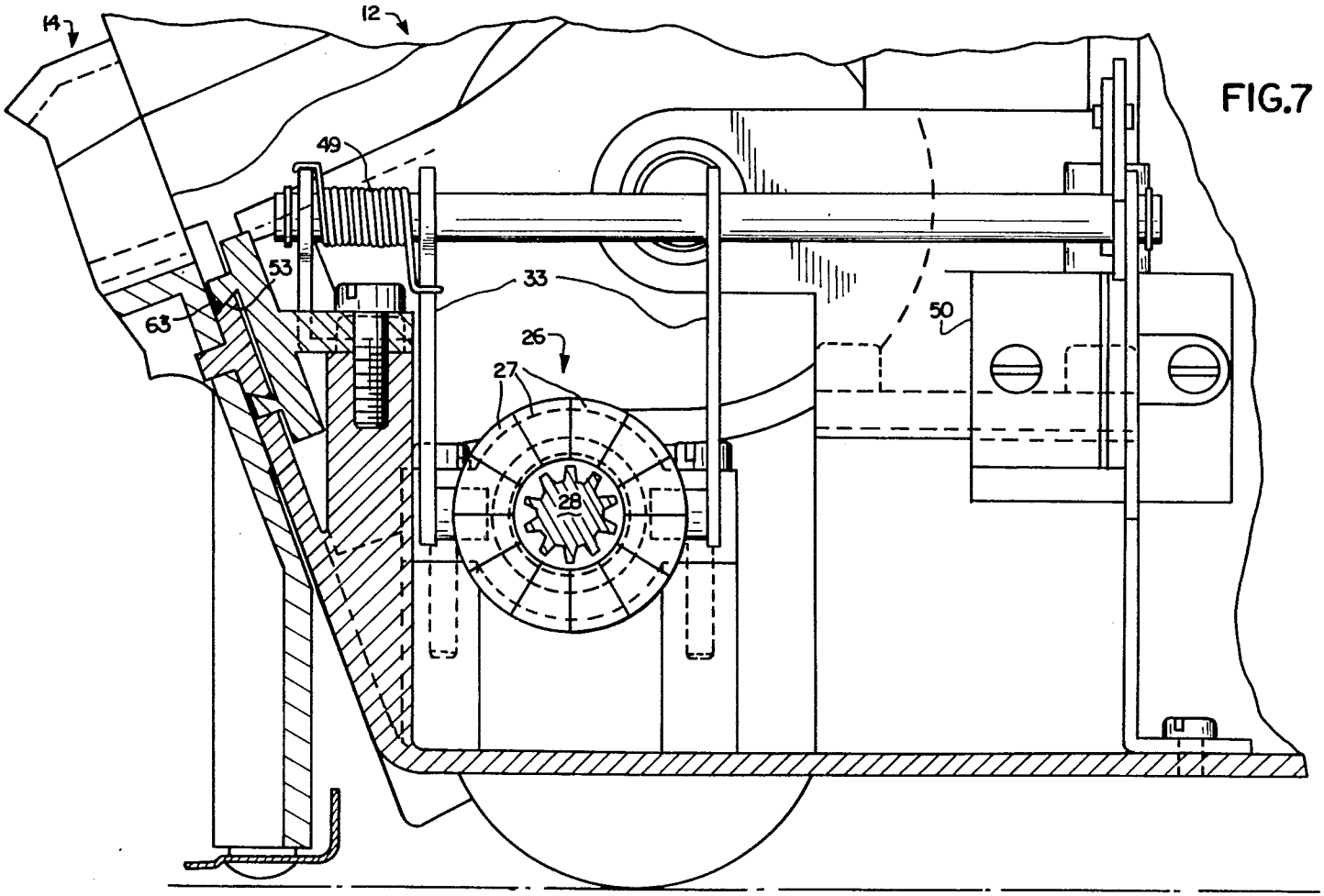

Referring now in more detail to the clutch 26, the teeth 25(3,6,8) of member 24 are engaged and disengaged by the teeth 27(3,6,7) of sliding member 29, which is splined to the output shaft 28. Fixed to sliding member 29 is a flanged member 31(6) which defines with the member 29 a groove for reception of the fingers of yoke 33(6,7). The yoke 33 is the output member of a spring-loaded bellcrank linkage driven in the engaging direction by solenoid 50(2–7) and in the disengaging direction by return spring 49 in a manner which will be apparent from the drawings. FIG. 6 shows the position of the parts when the clutch is disengaged and FIG. 6A shows their position when the clutch is engaged. The teeth 25,27 cam down on each other during engagement so that, no matter what their initial register, upon full clutch engagement their power transmitting faces are engaged. The areas of positive engagement between these faces give the clutch a very high torque-transmitting capacity for its size as compared to a friction clutch.

The turning on and off of the motor 18 and the activating and deactivating of the solenoid 50 are governed by control logic 80(2) embodied in any suitable microprocessor (not shown). Such a microprocessor may be mounted within the carriage 12 and be provided with conventional sensors (not shown) to feed back information as to condition or presence of various elements of the cleaner. The source 81(2) of a start or "on" signal may be a power switch manually actuated by the trigger 83(1), or by the closing of a handle-mounted toggle switch (not shown). The source 82(2) of a start or "off" signal may be simply the opening of the same switch. As can be seen from FIG. 2, the circuit logic 80 is such that when the user turns the vacuum cleaner on, the clutch solenoid is first energized to engage the clutch, and the motor is not turned on until the clutch has been engaged. On the other hand, when the user turns the vacuum cleaner off, the clutch does not disengage until the motor stops. Other logic may govern in appropriate modes; for example, when the duct 66 is raised, as for connection to a vacuum wand or the like, or when an alternative command switch or button is pushed to start operation in such mode, the motor will operate without engagement of the clutch, and indeed the solenoid 50 will remain unactivated and the clutch will remain disengaged throughout operation in that mode. However, the circuit logic 80 as described so far will always govern in the brush-and-vacuum mode when the removable powered brush vacuum nozzle is used.

Figure 2A:
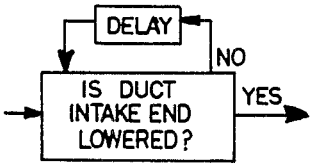
FIGS. 2A and 2B illustrate additions to the control logic of FIG. 2 which may be inserted individually or serially together at flow line portion 2A in FIG. 2.
Figure 2B:
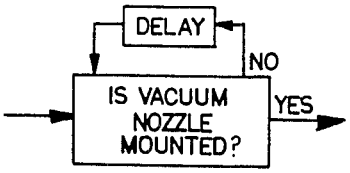
Figure 2:
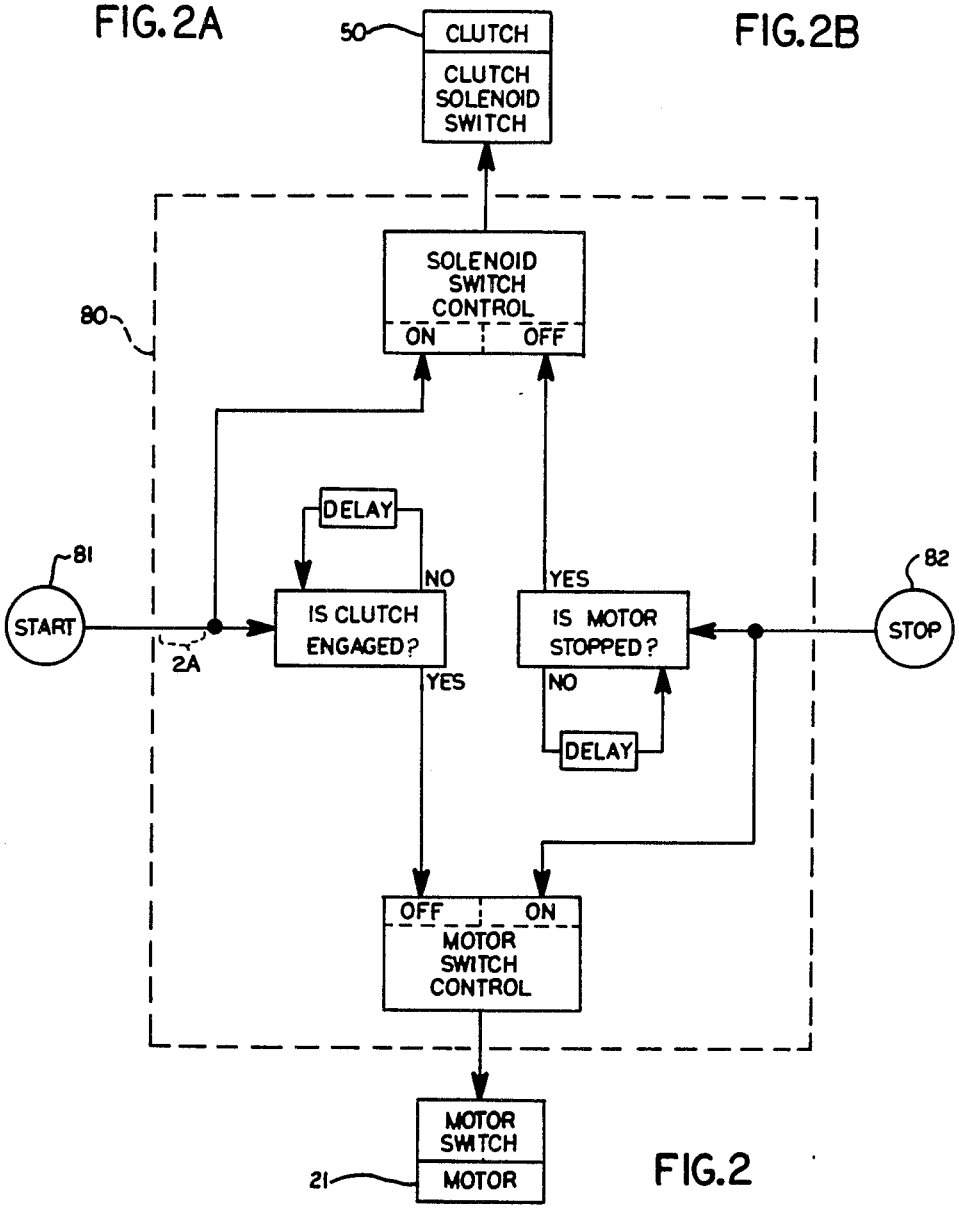
FIG. 2 illustrates the control logic for the turning on and off of the fan motor and the activating and deactivating of the clutch solenoid switch.
Figure 3:
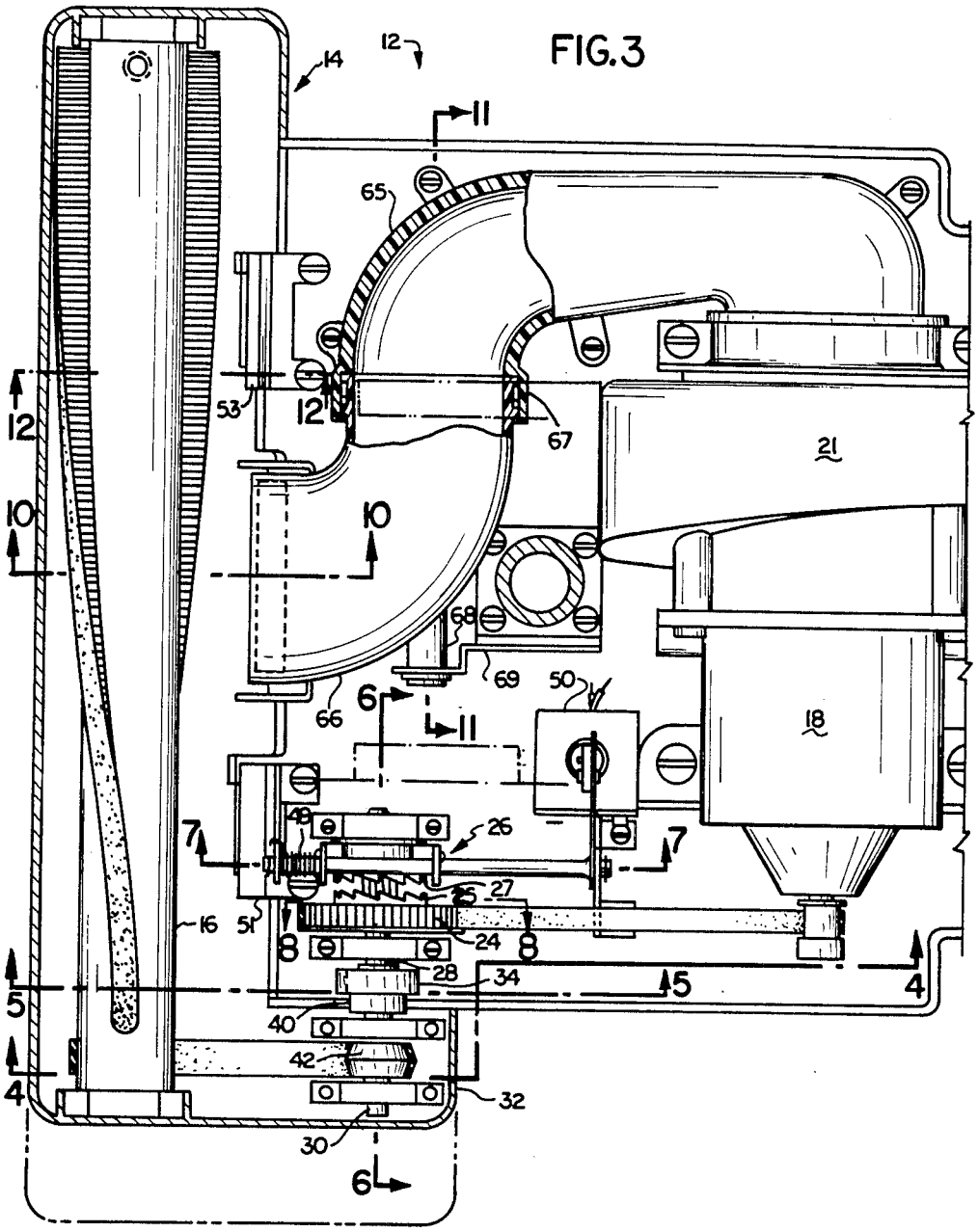
FIG. 3 is a sectional plan view of the parts seen in FIG. 1A in assembled condition.
Figure 4:
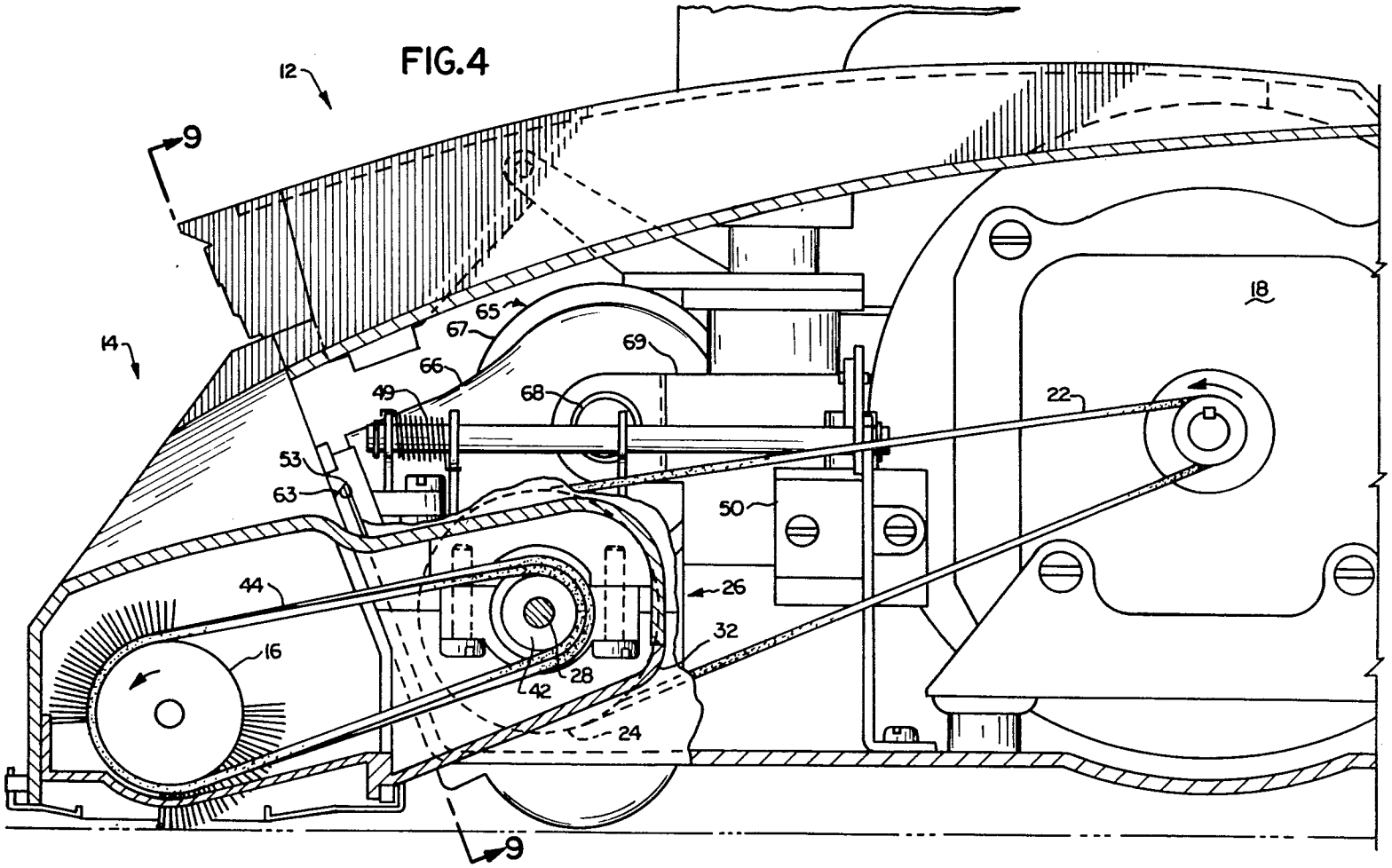

One logic arrangement to disable the clutch from engaging when pivotable duct member 66 is raised is indicated in FIG. 2A, which substitutes for the flow line portion included in the bracket 2A in FIG. 2. The sensor (not shown) may be of the microswitch type arranged to be closed only when duct member 66 is raised. The operation of this logic is to test for proper positioning of the intake end of the duct means before initiating clutch engagement.

As shown in FIG. 2B, an additional logic element may be provided responsive to a sensor, such as another microswitch type sensor (not shown) at the front face of the motor-fan carriage, such sensor being closed only when the vacuum nozzle is in mounted position. The logic of FIG. 2B may be serially connected with (i.e., immediately succeed or precede) the logic of FIG. 2A in the above-mentioned flow line portion. This assures that, regardless of the position of the pivotable duct member 66, the clutch is disabled from engaging whenever there is no vacuum nozzle or similar attachment mounted on the motor-fan carriage.

While the invention has been shown in a cleaner having interchangeable on-the-floor attachments, the use of a positive drive clutch in the vacuum head to engage and disengage the vacuum nozzle brush, and controlled in the manner described, is applicable whenever it is desired to provide a powered brush vacuum cleaner whose brush can be automatically disconnected when the cleaner is operated in modes that do not call for brush operation.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In a vacuum cleaner of the type having a motor-fan carriage and having a powered brush within a vacuum nozzle which is mounted on but removable from the fan motor carrier, said brush being driven by the fan motor while the cleaner is in a brush-and-vacuum mode, said driving being through a drive linkage which includes a torque-limiting slip connection, said cleaner having clutch means in the drive linkage to disconnect the drive to the brush of the attached nozzle during operation of the fan motor in modes other than the brush-and-vacuum mode and to connect the drive to the brush in such less-named mode, the improvement wherein said clutch means comprises a positive drive clutch in said drive linkage between the fan motor and said torque-limiting slip connection, and said vacuum cleaner includes control means active at the inception of each operation of said cleaner in said brush-and-vacuum mode to engage the clutch prior to starting the fan motor and active at the conclusion of operation of said cleaner in said brush-and-vacuum mode to disengage the clutch only after stopping the fan motor.

2. A device as in claim 1, said torque-limiting slip connection being carried entirely by said removable vacuum nozzle.

3. A device as in claim 2, said nozzle having a side extension at one end, said torque-limiting slip connection being in said side extension.

4. A device as in claim 3, said torque-limiting slip connection comprising a pulley on a stub shaft and a smooth belt engaged with said pulley, said smooth belt being in driving engagement with said brush.

5. A device as in claim 4, said positive drive clutch having an output shaft, power take-off means connecting said stub shaft and said output shaft being coaxial and positioned in end-to-end relationship and being joined by power take-off means.

6. A device as in claim 5, said power take-off means comprising socket means at the output end of the output shaft and finger means at the input end of the stub shaft.

7. In a vacuum cleaner of the type having a motor-fan carriage and having a powered brush within a vacuum nozzle which is mounted on but removable from the fan motor carrier, said brush being driven by the fan motor while the cleaner is in a brush-and-vacuum mode, said driving being through a drive linkage which includes a torque-limiting slip connection, said cleaner having clutch means in the drive linkage to disconnect the drive to the brush of the attached nozzle during operation of the fan motor in modes other than the brush-and-vacuum mode and to connect the drive to the brush in such last-named mode, the improvement wherein said vacuum nozzle is removably mounted on said motor-fan carriage by slideway means associated partially with said motor-fan carriage and partially with said vacuum nozzle, said mounting means being formed such that, following initial mutual engagement thereof, said vacuum nozzle becomes progressively more fully engaged in mounted relationship on said fan-motor carriage as said nozzle is translated laterally across the front of the carriage toward a fully engaged spring-latched position and becomes progressively less fully engaged in said mounted relationship as said nozzle is oppositely translated away from said fully engaged position, coupling means in said drive linkage and associated partially with said fan-motor carriage and partially with said vacuum nozzle, said coupling means comprising interengaging male and female members which progressively more fully mutually engage as an incident of said progressively fuller mutual engagement of said mounting means and progressively disengage as an incident of said progressively less full engagement of said mounting means, said parts also being formed such that, upon such initial mutual engagement of said mounting means associated with said vacuum nozzle and said motor-fan carriage, said male and female members of said coupling means are constrained to be properly aligned for engagement whereby both mounting and coupling are accomplished simply by positioning said nozzle for said initial mutual engagement with said motor-fan carriage and then sliding said nozzle to said spring-latched position.

8. A device as in claim 7, said torque-limiting slip connection included in said drive linkage being on the output side of said coupling means and entirely carried by said vacuum nozzle.

9. A device as in claim 8, said clutch means comprising a positive drive clutch in said drive linkage between the fan motor and said coupling means.

10. A device as in claim 7, said nozzle having duct-receiving means, said motor-fan carriage carrying duct means whose intake end is mounted for raising and lowering, said intake end being lowerable into said duct-receiving means following mounting of said vacuum nozzle on said motor-fan carriage, and being raisable out of said duct-receiving means while said vacuum nozzle is mounted for dismounting of said vacuum nozzle or for connection of vacuum wands or other vacuum tools that do not have linkage-driven brushes or other linkage-driven elements.

11. A device as in claim 10, said duct means including a pivotally mounted duct member, the intake of said duct member comprising said intake end of said duct means, the outlet end of said duct member being supported for rotation, on an imaginary axis that is transverse to said motor-fan carriage, by rotary joint means at the outlet of said output end and by additional rotary support means located at the intersection of said imaginary axis with the wall of said duct member, said rotary joint means comprising a joint between said duct member and the remainder of said duct means.

12. In a vacuum cleaner of the type having a motor-fan carriage and having a powered brush within a vacuum nozzle which is mounted on but removable from the fan motor carrier, said brush being driven by the fan motor while the cleaner is in a brush-and-vacuum mode, said driving being through a drive linkage which includes a torque-limiting slip connection, said cleaner having clutch means in the drive linkage to disconnect the drive to the brush of the attached nozzle during operation of the fan motor in modes other than the brush-and-vacuum mode and to connect the drive to the brush in such last-named mode, the improvement wherein said clutch means comprises a positive drive clutch in said drive linkage between the fan motor and said torque-limiting slip connection, said vacuum nozzle having vacuum-duct-receiving means, said fan-motor carriage carrying duct means whose intake end is mounted for raising and lowering, said intake end being lowerable into said vacuum-duct-receiving means following mounting of said vacuum nozzle on said motor-fan carriage, and being raisable out of said vacuum-duct-receiving means for connection of vacuum wands or other vacuum tools that do not have linkage-driven brushes or other linkage-driven elements, said vacuum cleaner further including control means active at the inception of each operation of said cleaner in said brush-and-vacuum mode to engage the clutch prior to starting the fan motor and active at the conclusion of operation of said cleaner in said brush-and-vacuum mode to disengage the clutch only after stopping the fan motor, said cleaner further including means to disable said clutch from any engaging when said intake end of said duct means is in raised position.

* * * * *